US005119750A

United States Patent [19]

Somers

[11] Patent Number: 5,119,750

[45] Date of Patent: Jun. 9, 1992

[54] SAIL DOUSING AND FLAKING SYSTEM

[75] Inventor: John E. Somers, New Baltimore, Mich.

[73] Assignee: Marjorie J. Somers, New Baltimore, Mich.

[21] Appl. No.: 573,353

[22] Filed: Aug. 27, 1990

Related U.S. Application Data

[63] Continuation-in-part of Ser. No. 376,316, Jul. 6, 1989, Pat. No. 4,986,205.

[51] Int. Cl.[5] ..... B63H 9/06

[52] U.S. Cl. ..... 114/104; 114/102

[58] Field of Search ..... 114/102-105, 114/108, 109, 111; 160/84.1-84.3; 59/86

[56] References Cited

U.S. PATENT DOCUMENTS

| | | | |
|---|---|---|---|
| 661,608 | 11/1900 | Holtzclaw | 160/84 |
| 4,688,506 | 8/1987 | Van Breem | 114/104 |
| 4,823,720 | 4/1989 | Foster | 114/98 |
| 4,864,952 | 9/1989 | Stevenson | 114/102 |
| 4,986,205 | 1/1991 | Somers | 114/104 |

OTHER PUBLICATIONS

Photographs pf shackles—taken by John E. Somers.
Dutchman—Patented sail handling system.
Battslide—Sailpower Systems, Inc.
Lazymate—North Sails.
Schaefer—p. 72 of 1988 Schaefer Marine Catalog.

*Primary Examiner*—Edwin L. Swinehart
*Attorney, Agent, or Firm*—Brooks & Kushman

[57] ABSTRACT

A system for dousing and flaking a sail is disclosed as including a plurality of sail-flaking devices and a douser line. The flaking devices are disposed at points spaced along the luff and the leech of the sail; and the douser line is affixed to one lower corner of the sail, passed through a block mounted to the head of the sail and returned to the other lower corner of the sail, the douser line passing slidably through passageways in the flaking devices disposed along the leech. The flaking devices spaced along the luff are self-actuating when the sail is being lowered; and the flaking devices spaced along the leech are controlled by the douser line. Adjacent flaking devices respectively rotate in one direction and then the other to flake the sail alternately from side to side as it descends and becomes flaccid.

17 Claims, 9 Drawing Sheets

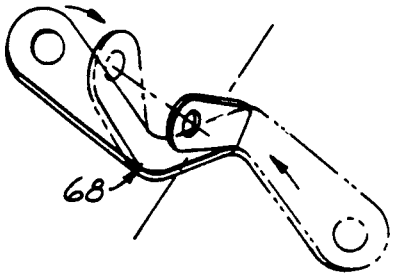
FIG.8
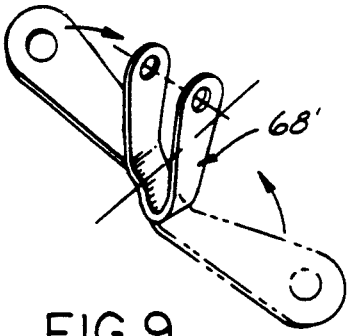
FIG.9
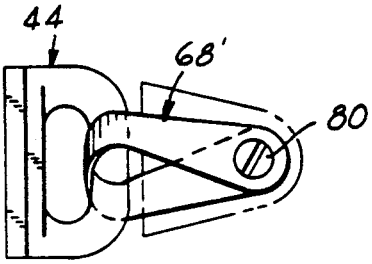
FIG. 10
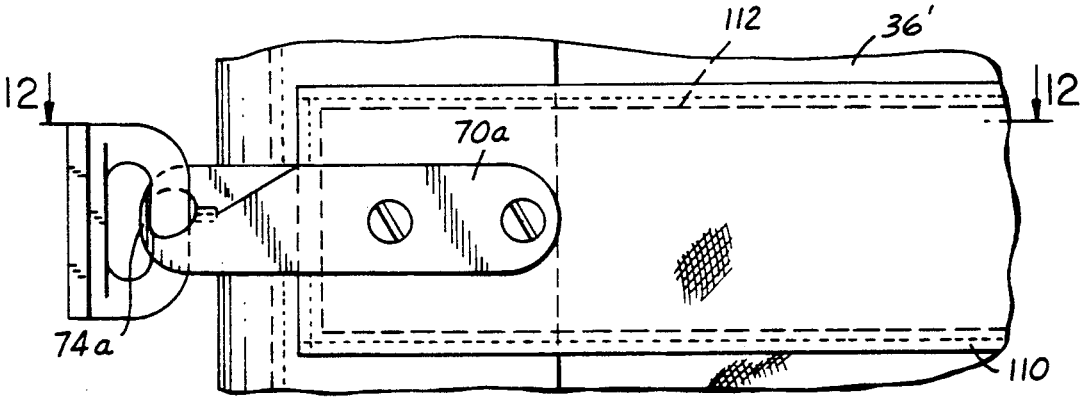
FIG. 11
FIG. 12
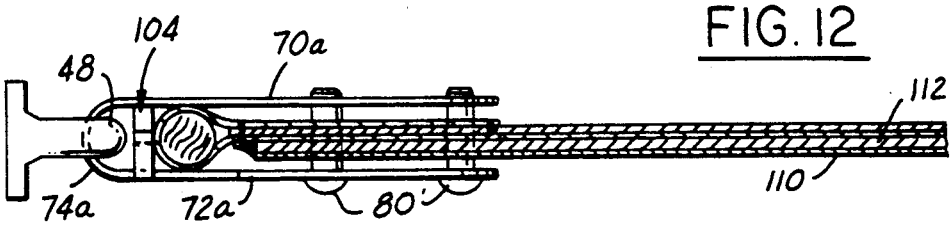
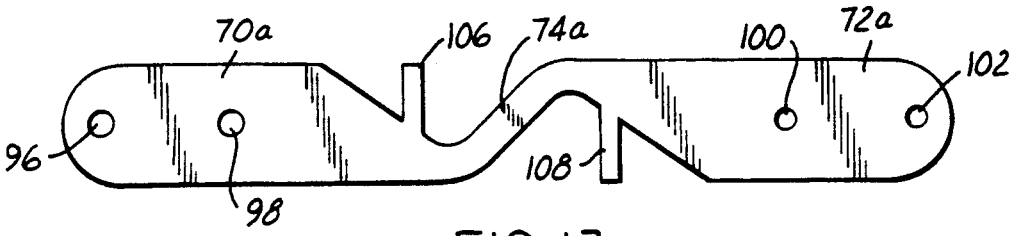
FIG. 13

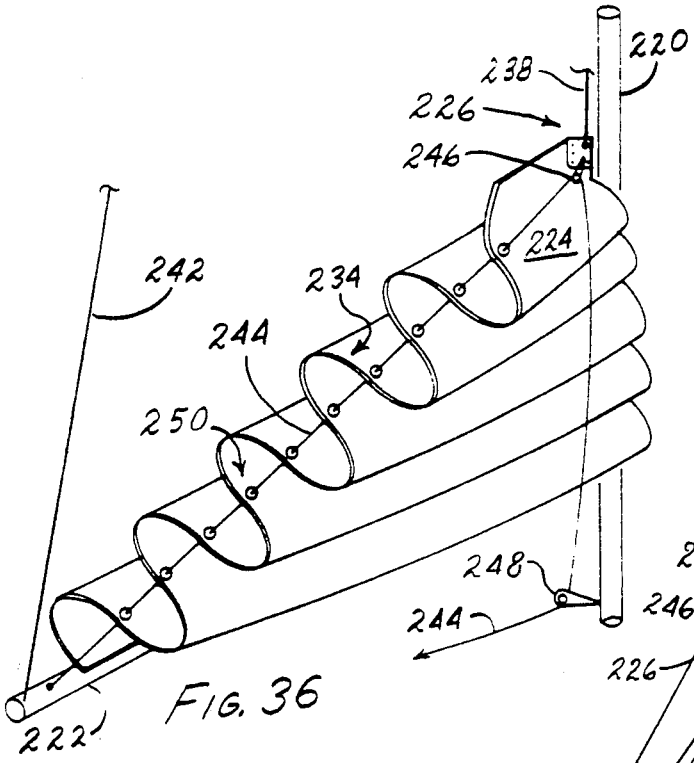
FIG. 36
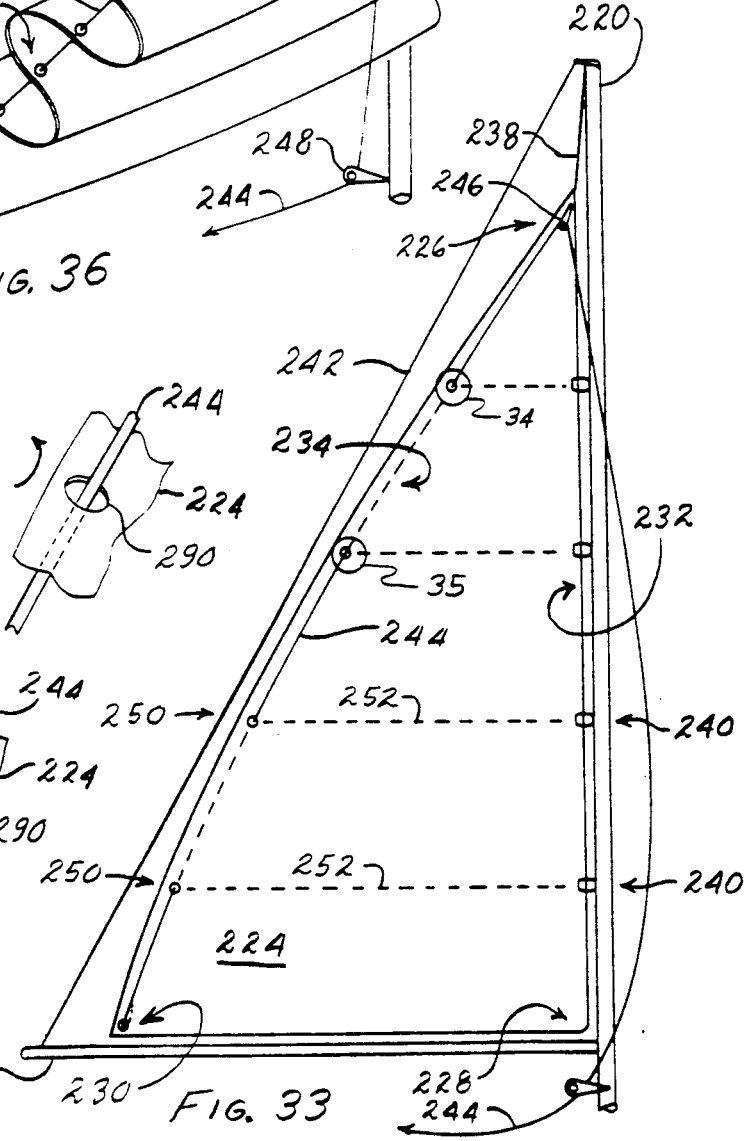
FIG. 33
FIG. 34
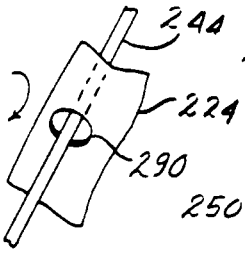
FIG. 35

SAIL DOUSING AND FLAKING SYSTEM

CROSS REFERENCE TO A RELATED APPLICATION

This patent application is a continuation-in-part of application Ser. No. 07/376,316, filed Jul. 6, 1989 and subsequently issued as U.S. Pat. No. 4,986,205 on Jan. 22, 1991.

TECHNICAL FIELD

This invention relates to a system for dousing a boat sail and causing the sail to flake as the sail is lowered.

BACKGROUND ART

This invention is an improvement in the self-flaking sail system disclosed in, and this patent application incorporates by reference all material contained in U.S. patent application Ser. No. 07/376,316, titled Self-Flaking Sail System, filed Jul. 6, 1989 and subsequently issued as U.S. Pat. No. 4,986,205 on Jan. 22, 1991. Embodiments of the apparatus disclosed and claimed in the referenced patent application constitute certain of the elements of the combination of the present application.

The conventional method for furling a sail is to release tension applied to it and gather it manually by bunching, rolling or flaking. Significant, economically feasible improvements in this method have been essentially limited to various forms of bagging, wherewith sails are pulled into elongate bags disposed along masts or booms or carried by the sail itself, and to roller furling, wherewith sails are wrapped around booms or stays as the latter are rotated. Bagging systems relatively conveniently secure the sails and may be configured to do so without requiring crew members to expose themselves to hazards attending leaving a cockpit to furl sails; but the bagging systems are relatively expensive, complicated and can develop problems at inopportune moments.

Roller furling apparatuses also have the advantages of being relatively convenient to use and of not usually requiring that crew members leave the cockpit to furl a sail. Roller furling apparatuses, however, require relatively complicated hardware, are often unusable with boomed sails such as mainsails, often reduce the efficiency of sails because they influence the shapes thereof, and can sometimes introduce handling problems during heavy winds when rolled sails wrap tighter than normal, leaving a portion of the sails unfurled to catch the wind.

Sails that are lowered for manual furling present a problem of maintaining control of the sail as it loses vertical tension and descends. Efforts have been directed toward designing means for automatically flaking sails as they are lowered. An example of this is disclosed in U.S. Pat. No. 4,688,506 to van Breeme. The van Breeme boat sail control system includes one or more control lines vertically disposed between a sailboat boom and an associated topping lift. Each control line passes through vertically aligned holes in the sail and runs along alternately opposite sides thereof. As the sail is lowered, oppositely facing folds are alternately formed in the sail, flaking the sail over the boom as the sail descends.

Another example of a system designed to automatically flake a descending sail onto a boom is disclosed in U.S. Pat. No. 4,864,952 to Stevenson. The Stevenson marine sail system provides a number of luff slides flexibly connected, at spaced-apart points, to the luff of the sail in canted orientations that alternate from slide to slide to impart a flaking moment to the luff as the sail is lowered.

A like number of brails are connected between spaced-apart points along the leech of the sail and a topping lift, the brails being slidably attached to the topping lift to permit movement therealong as the sail is raised and lowered, the brails being attached to the leech at points that are opposite to points of attachment of associated luff slides to the luff.

While each of these sail flaking systems functions with a certain degree of efficiency, none disclose the advantages of the improved sail douser and leech control system of the present invention as is hereinafter more fully described.

DISCLOSURE OF INVENTION

An object of the present invention is to provide an improved sail dousing and flaking system that douses a sail and causes it to flake over a boom as the sail descends and that may be configured to be operated from a cockpit to facilitate short-handed sailing.

Another object of the invention is to provide an improved sail dousing and flaking system that has a minimal adverse effect on sail shape and performance and that may aid in controlling sail shape.

Yet another object of the invention is to provide an improved sail dousing and flaking system that is completely operable with battened sails.

Still another object of the invention is to provide an improved sail dousing and flaking system that can be used with main, jib, mizzen and stay sails.

Another object of the invention is to provide an improved sail dousing and flaking system that requires the installation of essentially no components on a boat itself, that may be left on a sail, that is operable while the sail is up or down, and that is removable while the sail is up or down.

A further object of the invention is to provide an improved sail dousing and flaking system that is low cost, light weight and simple to operate.

Yet another object of the invention is to provide an improved sail dousing and flaking system that requires no unattractive and potentially damaging lines threaded through the sail.

Still another object of the invention is to provide an improved sail dousing and flaking system capable of holding the sail above the boom to facilitate drying the sail and to support a sail cover.

In realizing the aforementioned and other objects, the sail dousing and flaking system of the present invention includes means for connecting a sail luff at spaced-apart points to a sail track of a mast for both sliding movement along the track and rotation between positions in which the luff parallels the track or is arranged perpendicular thereto as occurs during flaking of a sail. Means are provided for limiting rotation of the sail luff at the spaced points and are arranged to prevent rotation first in one direction and then the other whereby, on lowering the sail, the luff is caused to flake first one way and then the other along the track.

The sail is connected to the track by sail slides and companion sail shackles having looped together generally U-shaped portions. At least one U-shaped portion lies in a plane inclined to the direction of the slide movement during sail raising and lowering and the U-shaped portions of the sail slide and shackle are dimensionally sized in relation to the angle of the incline to permit limited rotation between the slide and shackle from a position in which the sail luff is substantially perpendicular to the sail track. Successive sail slides and sail shackles cause the luff to flake first one way and then the other.

In one embodiment, each of the sail shackles disposed along the luff has an inclined bight portion to cause the controlled flaking, while in another embodiment the sail slide has an inclined bail to cause the controlled flaking. The invention is particularly useful also with full-batten sails.

The sail dousing and flaking system of the present invention also includes a douser line and a plurality of sail-flaking devices disposed at points spaced along the leech of the sail. The douser line is affixed to one lower corner of the sail, passed through a block mounted to the head of the sail and returned to the other lower corner of the sail, the douser line passing slidably through passageways in the flaking devices.

The passageways in adjacent flaking devices are oppositely angled with respect to the plane of the sail when the sail is under tension in a raised position. When tension is removed from the sail and is applied to the douser line to lower the sail, the sail area proximate the leech, now becoming flaccid, is flaked by the alternate rotations of adjacent flaking devices as their passageways are forced into alignment by the now tensioned douser line.

In one embodiment of the invention, the flaking device is a shackle affixed to the leech of a sail; in another embodiment, the flaking device is a relatively inflexible, perforated tab affixed to the leech; and, in yet another embodiment, the flaking device is formed of a perforated, reinforced portion in the leech.

The objects, features and advantages of the present invention are readily apparent from the following detailed description of the best mode for carrying out the invention when taken in connection with accompanying drawings.

BRIEF DESCRIPTION OF DRAWINGS

FIG. 8 illustrates how a flat shackle stamping is folded into its generally U-shape and which will cause a sail to flake in one direction;

FIG. 9 is similar to FIG. 8 but shows a sail shackle which has been oppositely folded to cause a sail to flake in the opposite direction from that of FIG. 8;

FIG. 10 shows the shackle of FIG. 9 mounted on a sail slide;

FIG. 11 shows the luff portion of a full-batten sail having one of my self-flaking sail shackles secured thereto to cause the batten to flake when the sail is lowered;

FIG. 12 is a cross-sectional view taken on line 12—12 of FIG. 11;

FIG. 13 is a plan view of a sail shackle blank for a full batten-sail prior to the blank having been folded into a U-shaped shackle configuration;

FIG. 23 is a side elevation of a sailboat mast, boom and mainsail embodying features of the invention;

FIG. 24 is a magnified view from area 24 of FIG. 23 showing a portion of the sail, a shackle and a douser line;

FIG. 25 is a magnified view from area 25 of

FIG. 23 showing a portion of the sail, another shackle and the douser line;

FIG. 33 is a side elevation of a sailboat mast, boom and mainsail embodying a variation of the features of the invention;

FIG. 34 is a magnified view from area 34 of FIG. 33 showing a portion of the sail, a shackle and a douser line;

FIG. 35 is a magnified view from area 35 of FIG. 33 showing a portion of the sail, another shackle and the douser line; and FIG. 36 is a partial view of FIG. 33 showing the sail partly furled.

BEST MODE FOR CARRYING OUT THE INVENTION

Figure 1:
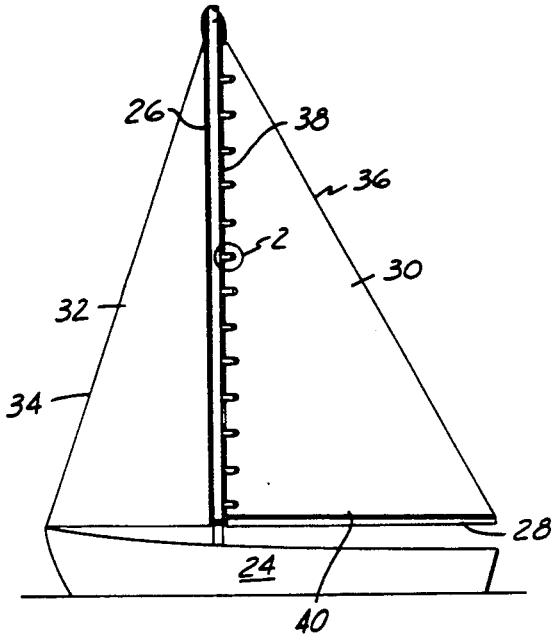
FIG. 1 is a side elevation of a sailboat having a mast, boom and sails embodying my invention.

In FIG. 1, I have shown a sailboat 24 having a mast 26, a boom 28, a mainsail 30 bent to the mast and boom, a jib 32 and a forestay 34 to which the job is bent. The mainsail includes a leech 36, a luff 38 and a foot 40. While the invention is applicable to the jib 32 and its connection to the forestay 34, the invention is described in relation to the mainsail's attachment to mast 26.

Figure 2:
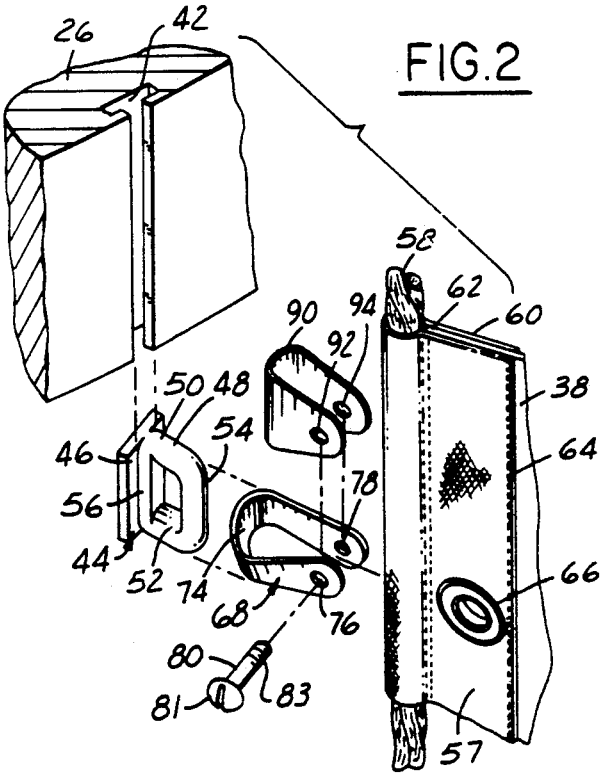
FIG. 2 is an exploded view from area 2 of FIG. 1 showing a portion of a mast and sail track, sail slide, shackle, anti-chafe member, and sail luff embodying my invention.

As show in FIG. 2, a fragmentary portion of the mast 26 shows a conventional sail track 42 formed in the after edge of the mast within which a conventional sail slide 44 may slide vertically up and down the mast. The sail slide has a base portion 46 and an upstanding, generally U-shaped bail portion 48 having a pair of legs 50, 52 connected by a bight portion 54. The legs 50, 52 are secured to the base 46 at an increased thickness area 56. The slide may be formed of plastic or metal or a combination thereof. In one embodiment of the invention, as shown in FIGS. 2–12, the sail slide is of conventional construction and readily available on the market. A series of these slides is introduced into the sail track 42 to serve as points of connection of the said luff of the mast.

Also as shown in FIG. 2, the mainsail includes a marginal luff portion 57 which, for purposes of illustration, includes a bolt rope 58 secured to the sail by strip of fabric 60 which has been folded around the bolt rope and stitched through the sail as at 62, 64. A grommet 66 of conventional construction extends through the fabric 60 and the sail 38 and serves as a point of attachment of the luff to the sail slide 44.

Figure 3:
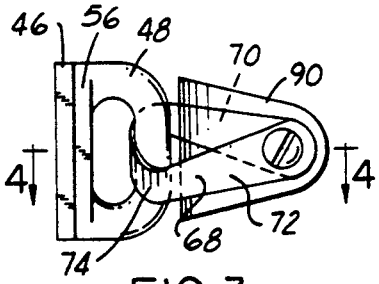
FIG. 3 is a side view of a sail shackle and sail slide embodying my invention.
Figure 4:
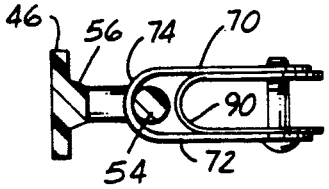
FIG. 4 is a cross-sectional view taken on the line 4—4 of FIG. 3.

Attachment of the luff to the sail slide is effected by the unique sail shackle 68 shown in FIGS. 2–4 and several other figures of the drawings. The shackle is of generally U-shaped configuration having a pair of legs 70 and 72 joined at one end by a bight portion 74 and having adjacent the free ends aligned apertures 76, 78 with aperture 78 being threaded and for a retainer pin 80 to be received through the apertures. The pin is threaded as at 83 to be threadedly connected in aperture 78. The legs 70 and 72 of the shackle embrace the marginal luff area of the sail and the pin 80 is extendible through the grommet 66 with the pin head 81 overlying the free end of leg 72 to lock the sail shackle on the sail with the legs closely embracing the opposed surfaces of the luff. The sail shackle 68 has its aperture 76, 78 lying in an imaginary plane which intersects the bight portion 74, with the bight portion crossing such plane at an angle of preferably approximately 52½°. This angular relationship is perhaps best shown in FIGS. 20–22 where the sail shackle is illustrated in its blanked out form prior to being folded into its U-shaped configuration.

Figure 20:
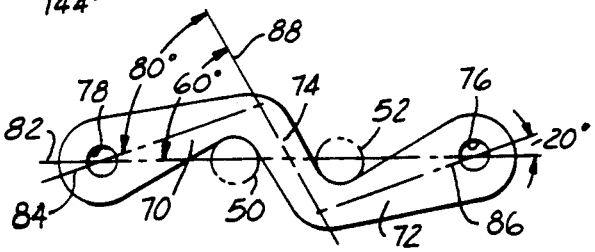

Considering FIG. 20, the shackle is shown in what may be referred to as a "lazy-z" configuration with the legs 70, 72 and the bight portion 74 being flat or coplanar. The apertures 76, 78 are also shown and for purposes of illustrating the relationship of the bail legs 50 and 62 such are shown in phantom outline. By folding the legs 70, 72 toward each other while maintaining the apertures 76, 78 in alignment, the apertures are in effect moved in a plane 82 such that on completion of the folding, the apertures will lie in transverse alignment in plane 82. The bight portion 74 of the shackle is formed in a curve as shown in FIGS. 2, 3, 4, 8 and 9. It will be noted from FIGS. 20–22 that the longitudinal axes 84, 86 of the legs are parallel before the shackle is formed up into its U-shaped configuration. The axis 88 of the bight portion is shown lying at an angle of 60° to the plane 82 in FIG. 20. Thus, when the flat shackle is folded into its U-shaped configuration as shown in either FIGS. 8 or 9, the angle of incidence between the bight portion 74 and a plane coincident with the transverse apertures 76, 78 lies at 60°. Similarly, in FIG. 21 the angle between the bight portion 74' and the imaginary plane through the transverse apertures lies at 52½° while in FIG. 22 the bight portion 74'' lies at the angle of 45 degrees to the imaginary plane coincident with the transverse apertures. My testing has indicated that the angle of incidence between the bight portion and a plane coincident with the transverse apertures may range from 30 to a maximum of about 80 degrees. The preferable angle of incidence is 52½ degrees.

Figure 5:
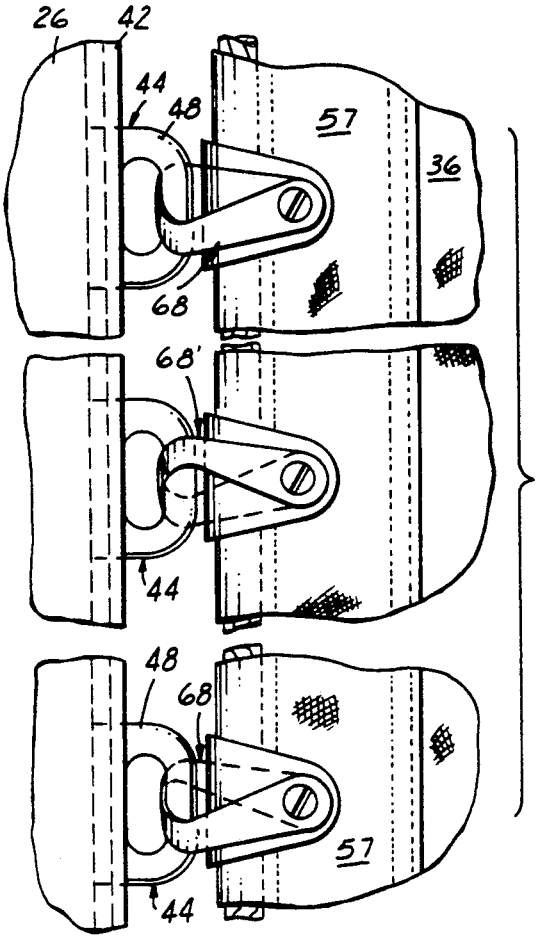
FIG. 5 shows three sail slides and connected shackles securing a sail luff to a sail track and illustrating the relationship of the parts when the sail is hoisted, and in normally-working relation with the sail track.
Figure 6:
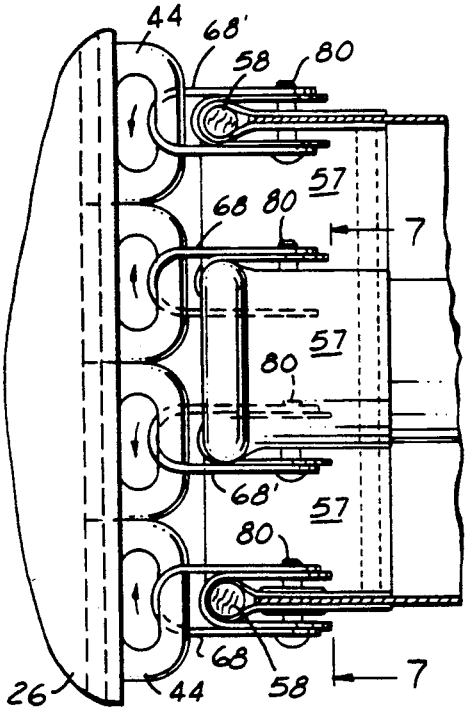
FIG. 6 is a view similar to FIG. 5 but with the sail lowered and flaked in accordance with the invention.
Figure 7:
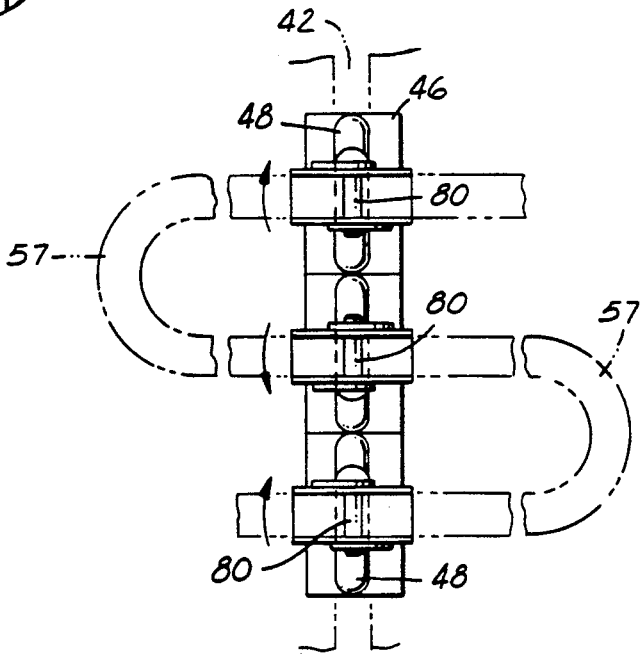
FIG. 7 is a cross-sectional view looking toward the sail track taken on the line 7—7 of FIG. 6.
Figure 21:
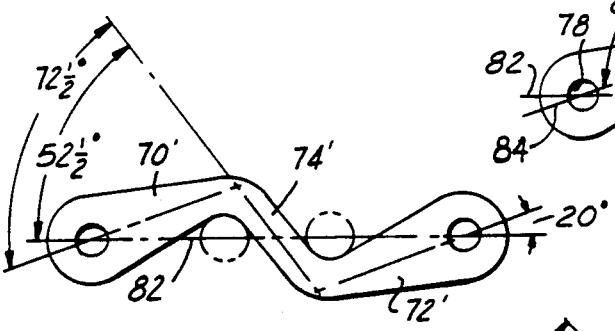
FIGS. 20–22 show three sail shackle blanks for different size shackles prior to bending into U-shaped configuration and illustrating important angular relationships.
Figure 22:
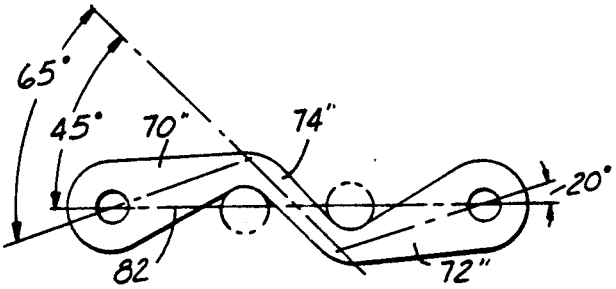

It will be noted that the way in which the sail shackle is folded, i.e., folded up or down as viewed in FIG. 20, will determine whether it will throw the sail luff one way or the other. For example, in FIGS. 2, 3 and 8 a right-hand shackle 68 is shown, which will throw the luff to the right as the sail is lowered, while in FIGS. 9 and 10 a left-hand shackle 68' is shown which will throw the luff to the left. FIGS. 5, 6 and 7 show that the right-hand and left-hand shackles are arranged successively along the luff to throw or flake the luff first one way and then the other as the sail is lowered. Looking, for example, at FIGS. 2 and 3, the shackie will prevent counterclockwise rotation and will throw the luff to the right when looking toward the sail track while the configuration shown in FIG. 10 will prevent clockwise rotation and throw the luff to the left. This is the result of the legs of the shackle having edges adapted to engage the bail 48 of the sail slide to limit rotation of the shackle on the bail between positions in which the pin 80 is either parallel to the bail as in FIG. 7 or perpendicular to the bail as in FIG. 5. In addition, the amount of twisting or flaking of the luff allowed by the shackle and bail is a function of the relation dimensions of the bail and the shackle legs. The angle of incidence between the shackle bight 74 and the imaginary plane 82 coincident with the transverse apertures 76 and 78 must be varied as the thickness of the bail legs and/or thickness of the shackle legs and shackle bight is varied. This is illustrated in FIGS. 20–22 where, for example, the legs 70, 72 are shown as being wider in FIG. 20 than in FIG. 22 and in FIG. 20 the angle of incidence is 160° while in FIG. 22, it is 45 degrees.

As shown in FIGS. 2, 3 and 4, an anti-chafe element 90 may be inserted into the shackle with aligned transverse hole 92 and 94 receiving the pin 80 therethrough. The anti-chafe element prevents the luff from rubbing the legs of the shackle or the bail 48 of the slide. The anti-chafe element may be formed of plastic or any other suitable material.

In FIGS. 11–13, I have shown a shackle particularly suitable for use with a full batten sail. The shackle is conceptually the same as that previously described, except the legs **70*a*, 72*a* are wider than the corresponding legs 70, 72 of the previously described shackle. In addition, the legs are provided with aligned pairs of apertures 96, 98, 100, 102 and the apertures 96, 98 may be threaded to receive therethrough the threaded end of pins 80'** corresponding to that previously described.

In addition, the shackle includes a transverse thrust bar 104 comprising tabs 106, 108 integral with the legs **70*a*, 72*a* and which overlap one another when the shackle is folded to bring the apertures 96, 98, 100, 102 into transverse alignment as shown in FIGS. 11 and 12. The thrust bar prevents the shackle from moving toward the sail track carrying the luff against the bail 48. The bight portion 74***a* is inclined to an imaginary plane coincident with aligned apertures 96, 98, 100, 102, similar to the inclination of the bight portion in the previously-described shackle. The full-batten sail with which the shackle of FIGS. 11, 12 and 13 is useable is provided with a batten pocket 110 which is stitched across the sail from luff to leech and receives a batten 112 therein. The pins 80' extend through suitable apertures in the batten. In this arrangement, when the sail is dropped, the self-flaking shackles will cause successive battens to flake first to the right and then to the left, thus flaking the sail across its width from luff to leech.

Figure 14:
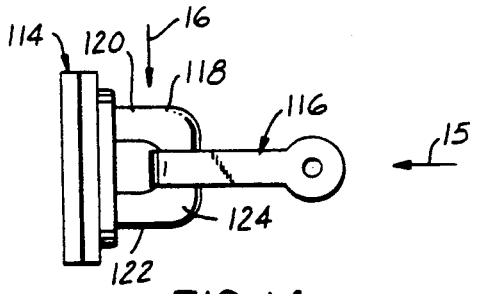
FIG. 14 is a side view of a sail slide having an inclined bail for causing a sail luff to flake in a controlled direction.
Figure 15:
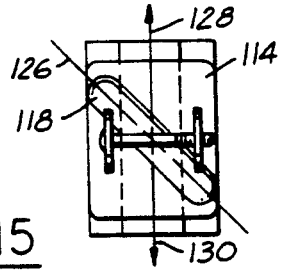
FIG. 15 is an end view looking in the direction of Arrow 15 of FIG. 14 showing the inclined relation of the sail slide bail in relation to the sail shackle.
Figure 16:
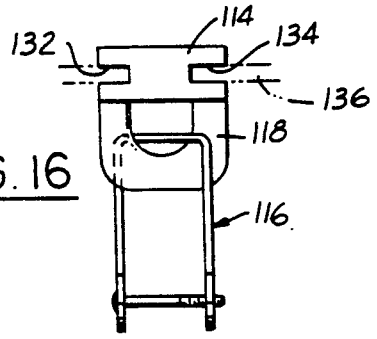
FIG. 16 is a top view of the device shown in FIG. 14 looking in the direction of Arrow 16 of FIG. 14.

In FIGS. 14–19 inclusive, I have shown a modification of the invention in which a conventional sail shackle is used in combination with a modified form of sail slide. The principle of operation is similar to that for the shackle previously described. In this embodiment, the sail slide 114 cooperates with a conventional U-shaped sail shackle 116. The slide is introduced in a suitable track, such as the track 42 previously described and the shackle 116 is secured to the luff of the sail similar to that heretofore described. The bail 118 in the embodiment of FIGS. 14, 15, and 16 is U-shaped with a pair of parallel legs 120, 122 connected by a bight portion 124. The bail lies in an imaginary plane 126, best shown in FIG. 15 which is inclined at an angle to the direction of movement of the slide represented by the arrows 128 and 130. This angle, similar to the angle previously discussed in connection with the first embodiment of the invention, may be anywhere from 30 to 80 degrees. Preferably, the angle is 45 degrees. As shown in FIG. 15, the shackle will be prevented from clockwise rotation, but will be permitted counter-clockwise rotation. Thus, this shackle may be referred to as a left-hand shackle as it will throw the luff to the left as a sail is lowered. Right-hand slides may be similarly provided so that successive slides may be right-hand and left-hand. As shown in FIG. 16, the slide may be provided with oppositely-disposed, outwardly-opening, mast-receiving grooves 132, 134 for embracing the marginal edges of a mast 136 at the sail track.

Figure 17:
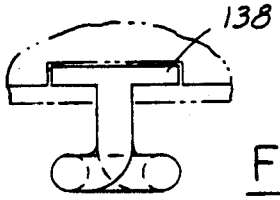
FIG. 17 is a modified form of the sail slide looking in the direction of Arrow 17 in FIG. 18.
Figure 18:
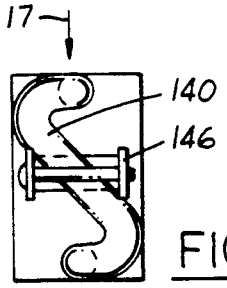
FIG. 18 is a view of the modified form of the sail slide of FIG. 17 looking at the slide in plan view and showing a sail shackle associated therewith.
Figure 19:
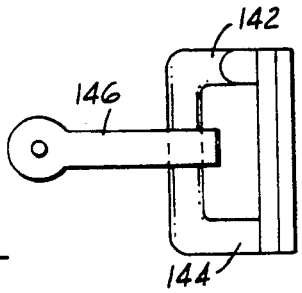
FIG. 19 is a side view of the sail slide and shackle shown in FIG. 18.

In FIGS. 17–19, I have shown a slightly modified form of the sail slide which is suitable for use in a track of the type shown in FIG. 2. In this case, the slide has a base portion 138 to be disposed within the track, similar to the track 42, and the base portion extends through the track slit similar to the bail of the slide 44. The bail, however, is of S-shaped configuration in plan view, as best shown in FIG. 18 to provide an inclined bight portion 140 connecting substantially parallel leg portion 142 and 144. The inclination of the bight portion 140 to the line of movement of the slide up and down the mast is, as previously described, preferably 52½° though it may vary to a greater or smaller angle depending upon the particular mast configuration and the like. A conventional shackle 146 is looped through the bail and connected to a sail luff. As shown in FIG. 18, the slide will prevent clockwise rotation of the shackle, but will permit counterclockwise movement, thereby allowing the luff to flake to the left. As in the embodiment of FIGS. 14–16, successive slides may be provided with alternately angled bail bights and, accordingly, a sail caused to flake first to the left and then to the right as it is lowered.

From the foregoing description, it is apparent that I have provided a series of pairs of interconnected sail slide and shackles which are spaced apart along the luff of a sail and the associated sail track, with the slides engaged with the track and the shackles engaged with the luff of the sail. Each shackle and slide of each pair has a generally U-shaped portion with such portions looped together to connect the slides and shackles. Such looped-together portions have contacting edge surfaces and are so angled with respect to each other that relative rotation between the angle and slide is limited to substantially 90 degrees, i.e., between a position in which the sail luff adjacent each of said pairs is parallel to the track as shown in FIG. 5 and a position in which the luff is perpendicular to the track as shown in FIG. 7. The permitted rotation is alternatively in opposite directions for successive pairs of shackles and slides and best shown in FIG. 7.

The slides and shackles above-described can be made of metal or plastic or any material that retains its shape and strength at sailing temperatures and can be round or flat and cast or molded as long as the shape described above is maintained.

Figures 23, 24, 25:
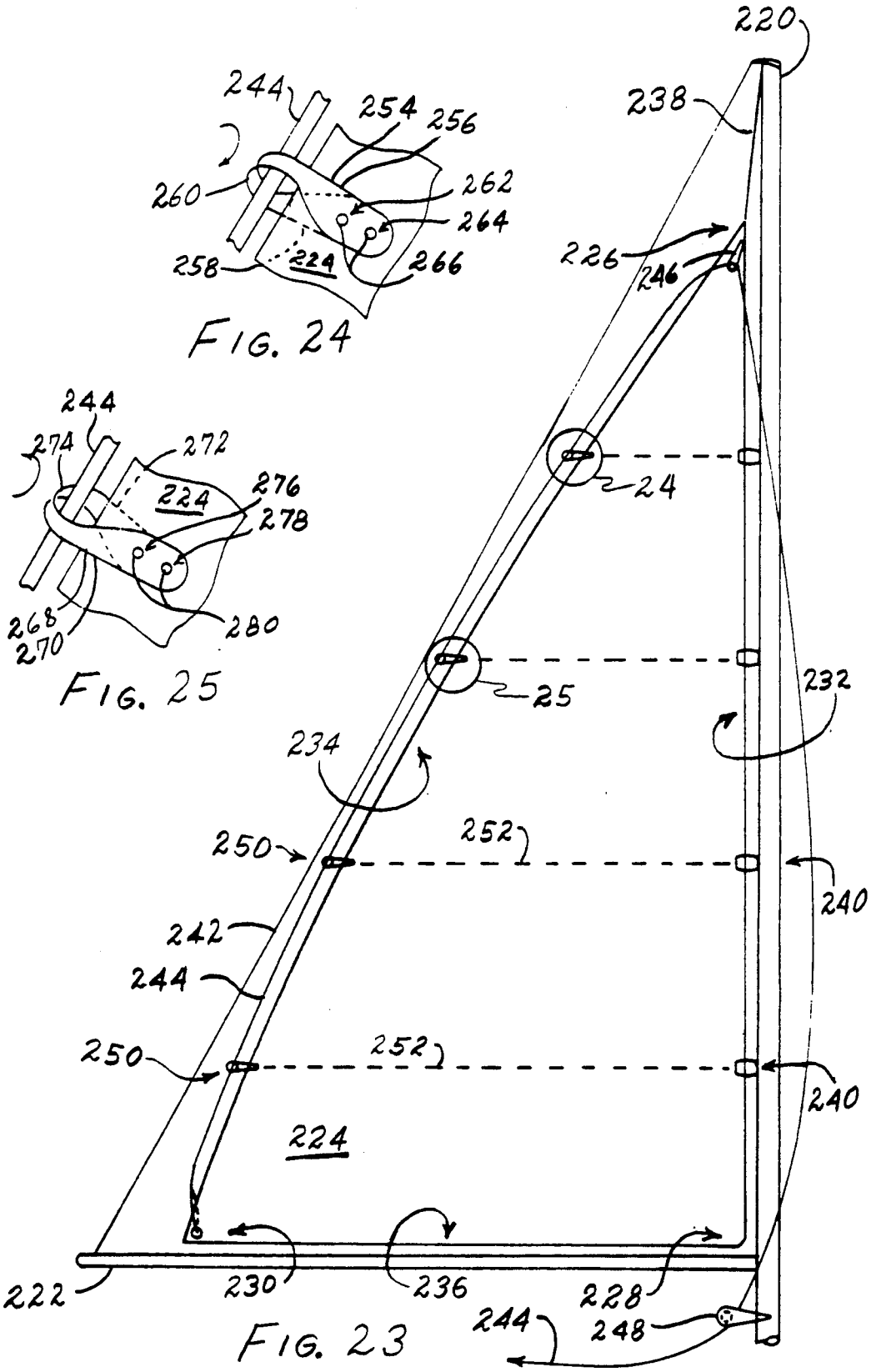

With reference to FIG. 23 of the drawings, shown is a sailboat mast 220 vertically mountable on a sailboat (not shown), a boom 222 pivotally mounted to the mast 220 and a main sail 224. The sail 224 has a generally triangular configuration, having a head, generally indicated by reference numeral 226, at an uppermost corner, a tack, generally indicated by reference numeral 228, at one lower corner and a clew, generally indicated by reference numeral 230 at the remaining lower corner. The sail 224 has a luff, generally indicated by reference numeral 232, along an edge extending between the head 226 and the tack 228, a leech, generally indicated by reference numeral 234, along an edge extending between the head 226 and the clew 230, and a foot, generally indicated by reference numeral 236, along the remaining edge extending between the tack 228 and the clew 230.

The sail 224 is vertically supported at the head 226 by a conventional halyard 238 depending from the mast 220. The luff 232 is slidably attached to the mast 220 with shackle-slide sets, generally indicated by reference numeral 240; and the foot 236 is slidably attached to the boom 222 in a similar fashion. The boom 222 is supported by a topping lift 242 depending from the mast 220 when the sail 224 is not in a raised position.

One, or a first, end of a douser line 244 is attached to the sail 224 at the clew 230. The free, or a second, end of the douser line 244 is run through a head block 246 and then through a tack block 248. The head block 246 can be mounted to the head 226 of the sail 224, and the tack block 248 can be mounted to the tack 228 of the sail 224 or to the mast 220 (as shown) or boom 222 proximate the tack 228. With the head block 246 and the tack block 248 both attached to the sail 224, the sail 224 and the douser line 244 can be mounted and removed as a unit. After passing through the tack block 248, the free end of the douser line 244 can be secured to a cleat near the tack 228 or routed to a cockpit (not shown) of the sailboat so that the sail 224 can be doused without a crew member having to leave the cockpit.

Attached to the leech 234 of the sail 224 are a number of shackles generally indicated by reference numeral 250. As indicated by dashed lines 252, the shackles 250 are mounted to the leech 234 of the sail 224 at vertical positions opposite the positions at which the shackle-slide sets 240 are mounted to the luff 232. The douser line 244 passes slidably through the shackles 250.

As shown in detail by FIGS. 24 and 25 respectively, the shackles 250 are of two respective configurations. A first shackle, or flaking device, 254, shown by FIG. 24, is of a generally U-shaped configuration having a pair of legs 256 and 258 joined at one end by a bight portion 260 and having proximate the other ends a pair of aligned apertures, generally indicated by reference numerals 262 and 264. The legs 256 and 258 straddle a portion of the leech 234 of the sail 224 and are fastened together by conventional means such as rivets, or other elongate fasteners, 266 passing through the apertures 262 and 264 and the leech 234. The bight portion 260 of the first flaking device 254 defines a passageway through which the douser line 244 passes, the passageway being inclined to a first side of the plane of the leech 234 by an angle between 10 and 60 degrees and preferably by an angle of approximately 37½ degrees.

A second shackle, or flaking device, 268, shown by FIG. 25 of the drawings, is of a generally U-shaped configuration having a pair of legs 270 and 272 joined at one end by a bight portion 274 and having proximate the other ends a pair of aligned apertures, generally indicated by reference numerals 276 and 278. The legs 276 and 278 straddle a portion of the leech 234 of the sail 224 and are fastened together by conventional means such as rivets, or other elongate fasteners, 280 passing through the apertures 276 and 278 and the leech 234.

The bight portion 274 of the second flaking device 268 defines a passageway through which the douser line 244 passes, the passageway being inclined to the second side of the plane of the leech 234 by an angle between 10 and 60 degrees and preferably by an angle of approximately 37½ degrees. The shackles 250 along the leech 234 of the sail 224 alternate, a first flaking device 254 being followed in turn by a second flaking device 268, the second flaking device 268 being followed by another first flaking device 254, and so on. Progressing upwardly, viewing the sail edge-on from a position aft of the leech 234, the passageways defined by the shackles 250 alternately angle to the left and then to the right, the douser line 244 being directed therethrough also being alternately angled to the left and then to the right.

Figure 26:
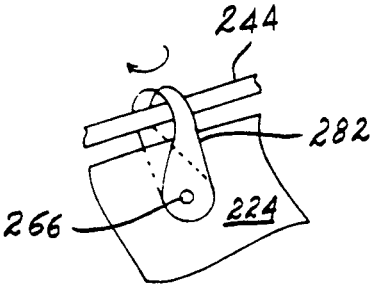
FIG. 26 is a view similar to that of FIG. 24 showing a portion of the sail, a variation of the shackle shown by FIG. 24, and the douser line.
Figure 27:
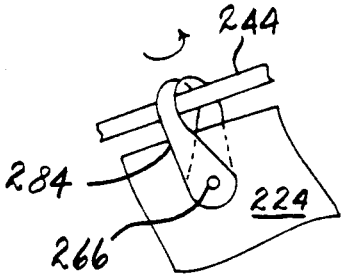
FIG. 27 is a view similar to that of FIG. 25 showing a portion of the sail, a variation of the shackle shown by FIG. 25, and the douser line.

In another embodiment of the sail dousing and flaking system, flaking devices 282 and 284, respectively shown by FIGS. 26 and 27, are substituted for the first and second flaking devices 254 and 268 respectively. They are similar except that they are fastened to the leech 234 of the sail 224 by only one elongate fastener 266 rather than by two. This allows the flaking devices 282 and 284 to rotate to a limited degree about the elongate fasteners 266.

With reference to FIG. 23 of the drawings, when the sail 224 is to be doused, the tension on the halyard 238 is reduced or removed; and the free end of the douser line 244 is pulled. The douser line 244 pulls the head 226 of the sail 224 downwardly, the douser line 244 sliding through the shackles 250 and through the head block 246 and the tack block 248. As tension is applied to the douser line 244, it is pulled taut and therefore straight.

As the douser line 244 straightens, it aligns the passageways defined by all the shackles 250. This rotates the shackles 250 in alternately opposite directions since they are no longer held in their original orientations by the stiffness of the leech 234, which has been allowed to become flaccid under the reduced tension applied thereto by the halyard 238. As the shackles 250 rotate in alternately opposite directions, the portions of the sail 224 proximate the leech 234 are also directed in alternately opposite directions, causing the sail 224 to flake.

Figure 28:
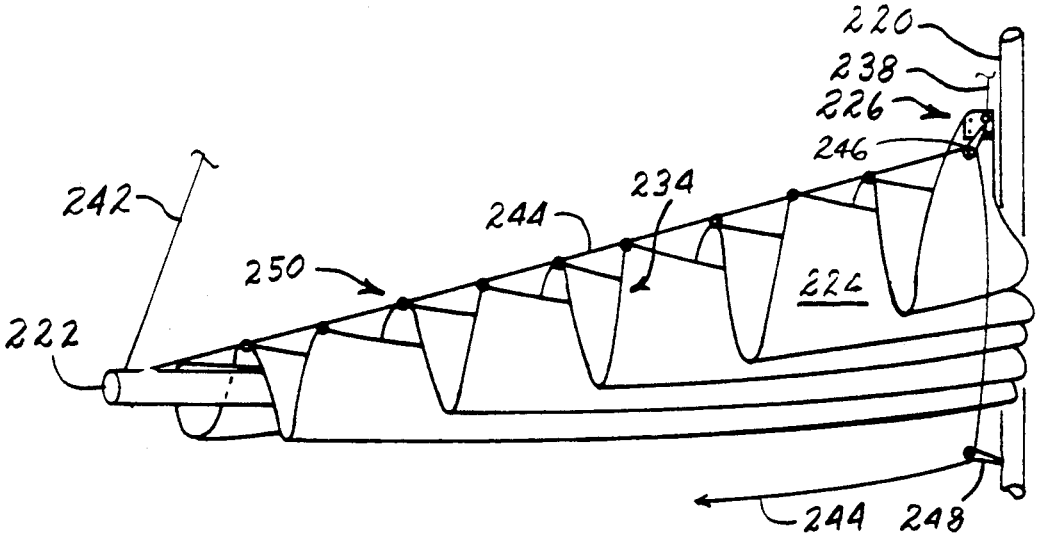
FIG. 28 is a partial view of FIG. 23 showing the sail partly furled.

As the sail 224 continues to descend, it eventually reaches a position shown by FIG. 28 of the drawings, the leech 234 being supported by the douser line 244 and the sail 224 being flaked over the boom 222. As illustrated, the sail 224, being supported by the douser line 244 is not permitted to collapse onto a deck or cabin top where it might become damaged, become entangled with running gear or become a hazard to crew members. The sail 224 may be left in this position to dry, or it may be lowered to the boom 222 by releasing tension on the douser line 244.

Figures 29, 30, 31:
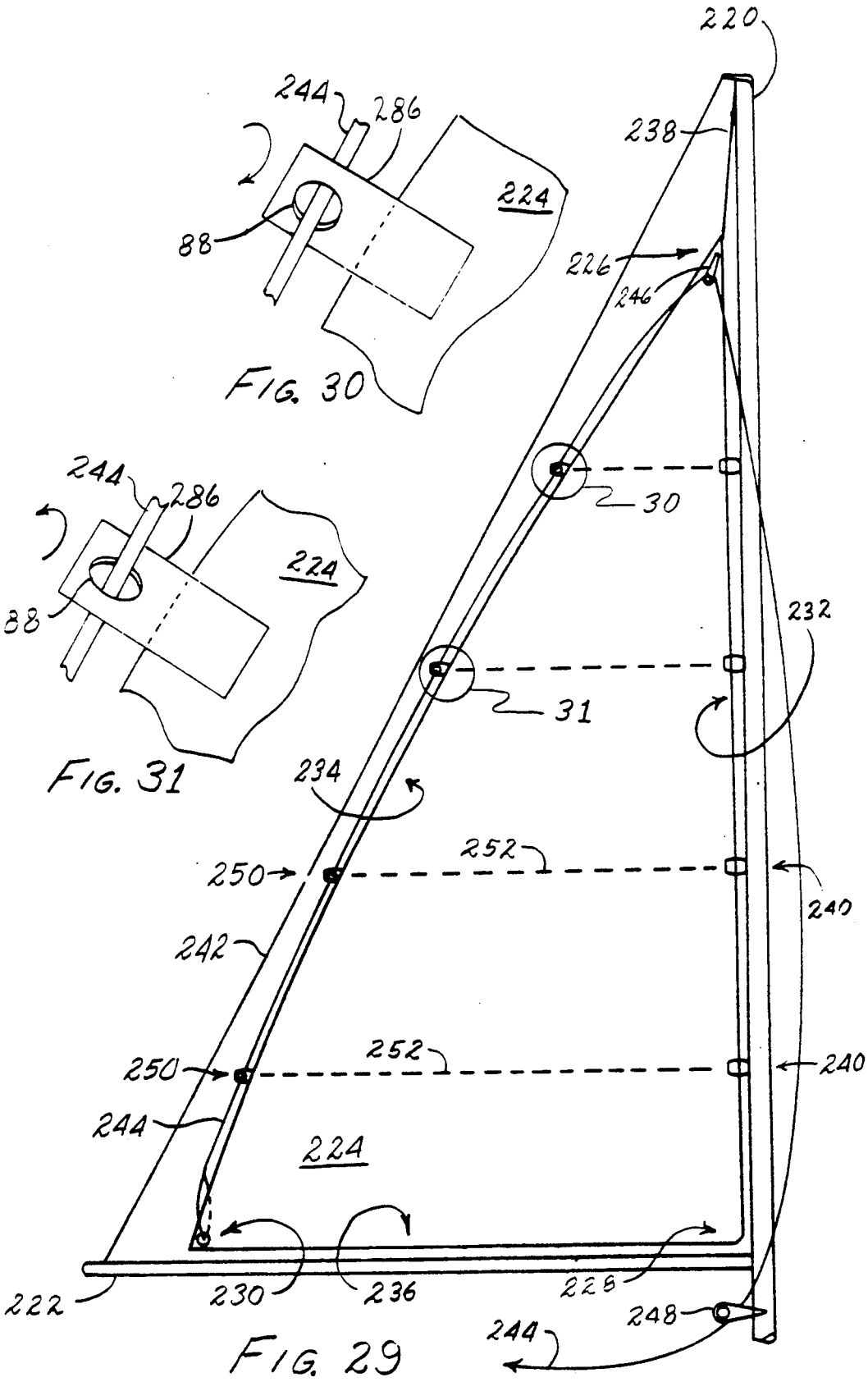
FIG. 29 is a side elevation of a sailboat mast, boom and mainsail embodying a variation of the features of the invention.
FIG. 30 is a magnified view from area 30 of FIG. 29 showing a portion of the sail, a shackle and a douser line.
FIG. 31 is a magnified view from area 31 of FIG. 29 showing a portion of the sail, another shackle and the douser line.

Another embodiment of the sail dousing and flaking system is shown by FIG. 29 of the drawings. In this embodiment, each of the shackles 250, as shown in greater detail by FIGS. 30 and 31, is formed of a relatively inflexible, elongate tab 286 having a substantially flat surface and being affixed to the leech 234 of the sail 224. Each tab defines an aperture 288 that functions as a passageway through which the douser line 244 slidably passes. All tabs 286 are substantially alike; however, the douser line 244 passes through each successive tab 286 in an opposite direction.

Figure 32:
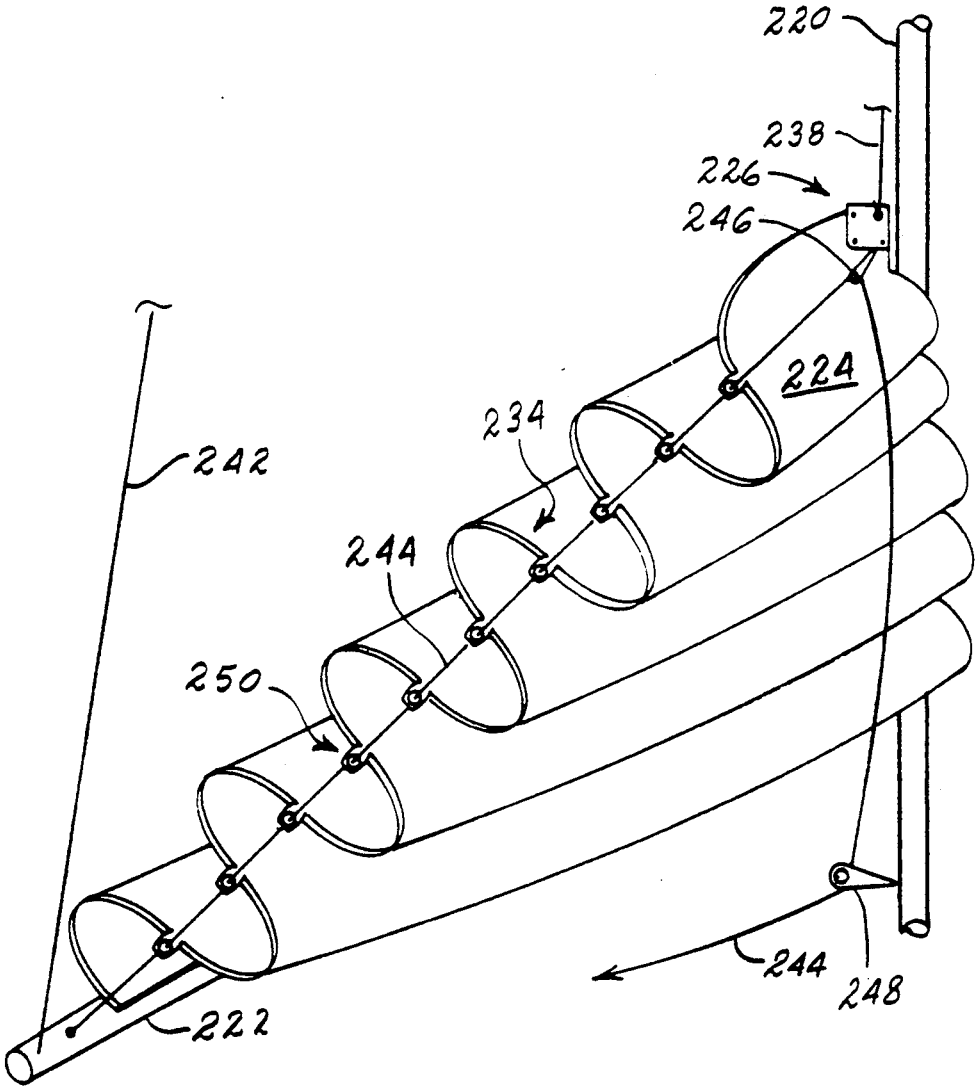
FIG. 32 is a partial view of FIG. 29 showing the sail partly furled.

When the douser line 244 is slack and the sail 224 is under tension in a raised position, the resulting stiffness of the leech 234 holds the plane of the tab 286 coincident to that of the leech 234. With reference to FIG. 32 of the drawings, when the sail 224 is to be doused, the tension on the halyard 238 is reduced or removed; and the free end of the douser line 244 is pulled. The douser line 244 pulls the head 226 of the sail 224 downwardly, the douser line 244 sliding through the shackles 250 and through the head block 246 and the tack block 248. As tension is applied to the douser line 244, it is pulled taut and therefore straight.

As the douser line 244 straightens, it aligns the passageways defined by all the tabs 286. This rotates the tabs 286 in alternately opposite directions since they are no longer held in their original orientations by the stiffness of the leech 234, which has been allowed to become flaccid under the reduced tension applied thereto by the halyard 238. As the shackles 250 rotate in alternately opposite directions, the portions of the sail 224 proximate the leech 234 are also directed in alternately opposite directions, causing the sail 224 to flake. As the sail 224 continues to descend, it eventually reaches a position shown by FIG. 32 of the drawings, the leech 234 being supported by the douser line 244 and the sail 224 being flaked over the boom 222.

Still another embodiment of the sail dousing and flaking system is shown by FIG. 33 of the drawings. In this embodiment, each of the shackles 250 is replaced by an aperture 290 defined in a reinforced portion of the leech 234 as shown in greater detail by FIGS. 34 and 35. Each aperture 290 functions as a passageway through which the douser line 244 slidably passes. All the apertures 290 are substantially alike; however, the douser line 244 passes through each successive aperture 290 in an opposite direction.

When the douser line 244 is slack and the sail 224 is under tension in a raised position, the resulting stiffness of the leech 234 holds the axis of the apertures 290 substantially at right angles to the plane of the leech 234. With reference to FIG. 36 of the drawings, when the sail 224 is to be doused, the tension on the halyard 238 is reduced or removed; and the free end of the douser line 244 is pulled. The douser line 244 pulls the head 226 of the sail 224 downwardly, the douser line 244 sliding through the apertures 290 in the leech 234 and through the head block 246 and the tack block 248. As tension is applied to the douser line 244, it is pulled taut and therefore straight.

As the douser line 244 straightens, it aligns the passageways defined by all the apertures 290 in the leech 234. This rotates the axes of the apertures 290 in alternately opposite directions since they are no longer held in their original orientations by the stiffness of the leech 234, which has been allowed to become flaccid under the reduced tension applied thereto by the halyard 238. As the apertures 290 rotate in alternately opposite directions, the portions of the sail 224 proximate the leech 234 are also directed in alternately opposite directions, causing the sail 224 to flake. As the sail 224 continues to descend, it eventually reaches a position shown by FIG. 36, the leech 234 being supported by the douser line 244 and the sail 224 being flaked over the boom 222.

With respect to the douser line 244, it should be understood that its configuration may have several variations. As illustrated by, for example, FIG. 23, the douser line 244 is attached to the sail 224 at the clew 230. The free end of the douser line 244 is run through the shackles 250, through the head block 246, and through the tack block 248. The head block 246 is mounted to the head 226 of the sail 224, and the tack block 248 can be mounted to the tack 228 of the sail 224 or to the mast 220 (as shown) or boom 222 proximate the tack 228. With the head block 246 and the tack block 248 both attached to the sail 224, the sail 224 and the douser line 244 can be mounted and removed as a unit. After passing through the tack block 248, the free end of the douser line 244 can be secured to a cleat near the tack 228 or routed to the sailboat cockpit.

Another variation of the douser line configuration is, for example, to attached the douser line 244 proximate the tack 228 of the sail 224, run it through the head block 246, and through the shackles 250 to a cleat or another block at the clew 230. Loosening the halyard 238 and pulling on the douser line 244 lowers the sail 224, supports the leech 234 and flakes the sail 224 in a manner similar to the previously described.

Another variation of the douser line configuration is, for example, to attached the douser line 244 proximate the head 226 of the sail 224, run it through the shackles 250 to a cleat or another block at the clew 230. As in the previous variation, loosening the halyard 238 and pulling on the douser line 244 lowers the sail 224, supports the leech 234 and flakes the sail 224.

The flaking devices previously described can be made of metal or plastic, or of any material that retains its shape and strength at sailing temperatures, and can be round or flat and cast or molded as long as the shape described is maintained.

While the best mode for carrying out the invention has been described in detail, those familiar with the art to which this invention relates will recognize various alternative designs and embodiments for practicing the invention as disclosed by the following claims.

What is claimed is:

1. A system for causing controlled flaking of a sail as it is lowered comprising, in combination:

a sail track for arrangement in a generally vertical plane;

a sail having a luff for attachment to said track and also having a head, a leech and a clew;

means for connecting the sail luff at spaced-apart points therealong to said sail track for sliding movement along said sail track and for rotation between positions either parallel to or angled to said track;

said means having rotation limiting portions at each of said spaced points arranged to prevent rotation in first one direction and then the other at said successive spaced points whereby, on lowering the sail, the luff is caused to flake first one way and then the other along the track;

a plurality of first flaking devices attached to the leech of the sail at points spaced therealong, each of the first flaking devices defining a passageway therethrough, the passageway having a principal axis disposed at a first angle with respect to the substantially vertical plane of the sail when the latter is under tension in a raised position;

a plurality of second flaking devices attached to the leech of the sail at points intermediate those at which the first flaking devices are attached, each of the second flaking devices defining a passageway therethrough, the passageway having a principal axis disposed at a second angle with respect to the substantially vertical plane of the sail, the first and second angles extending from opposite sides of the substantially vertical plane of the sail; and a continuous douser line having a first end and a second end and an intermediate portion disposed therebetween, the first end thereof being affixed to the sail proximate the head of the sail, the intermediate portion of the douser line being run through successive passageways in the first and second flaking devices, the douser line being substantially flaccid when the sail is in its raised position, the douser line being substantially straightened when tension applied to the sail to maintain it in its raised position is removed and a tensioning force is applied proximate the second end of the douser line to pull the sail downwardly, the straightened douser line forcing the principal axes of the passageways into alignment and rotating the first and second flaking devices in alternately opposite directions, the first and second flaking devices flaking the lower sail proximate the leech thereof in alternately opposite directions as the sail descends.

2. A system for dousing a sail, the sail having a head, foot, a leech, a luff, a tack at one lower corner and a clew at the other lower corner, and for controlling the leech thereof, the system comprising:

a plurality of first flaking devices attached to the leech of the sail at points spaced therealong, each of the first flaking devices defining a passageway therethrough, the passageway having a principal axis disposed at a first angle with respect to the substantially vertical plane of the sail when the latter is under tension in a raised position;

a plurality of second flaking devices attached to the leech of the sail at points intermediate those at which the first flaking devices are attached, each of the second flaking devices defining a passageway therethrough, the passageway having a principal axis disposed at a second angle with respect to the substantially vertical plane of the sail; and a douser line having a first end and a second end and an intermediate portion disposed therebetween, the first end thereof being affixed to the sail proximate the head of the sail, the intermediate portion of the douser line being run through successive passageways in the first and second flaking devices, the douser line being substantially flaccid when the sail is in its raised position, the douser line being substantially straightened when tension applied to the sail to maintain it in its raised position is removed and a tensioning force is applied proximate the second end of the douser line to pull the sail downwardly, the straightened douser line forcing the principal axes of the passageways into alignment and rotating the first and second flaking devices in alternately opposite directions, the first and second flaking devices flaking the lowering sail proximate the leech thereof as the sail descends.

3. The system defined by claim 2, wherein each first and second flaking device is generally U-shaped and includes a pair of legs that are joined at one end by a bight portion, each leg having defined proximate its other end a pair of apertures, each aperture in one leg being aligned with a respective aperture in the other leg, the pair of legs straddling a portion of the leech and being fastened together by a pair of elongate fasteners passing through the apertures and the leech.

4. The system defined by claim 2, wherein each first and second flaking device is generally U-shaped and includes a pair of legs that are joined at one end by a bight portion, each leg having defined proximate its other end an aperture, the aperture in one leg being aligned with the aperture in the other leg, the pair of legs straddling a portion of the leech and being fastened together by an elongate fastener passing through the apertures and the leech, each first and second flaking device being free to rotate to a limited degree about the elongate fastener.

5. The system defined by claim 3, wherein the first and second angles lie between 10 and 60 degrees.

6. The system defined by claim 5, wherein the first and second angles are substantially 37½ degrees.

7. The system by claim 4 wherein the first and second angles be between 10 and 60 degrees.

8. The system defined by claim 7, wherein the first and second angles are substantially 37½ degrees.

9. A system for dousing a sail, the sail having a head, a foot, a leech, a luff, a tack at one lower corner and a clew at the other lower corner, and for controlling the leech thereof, the system comprising:

a plurality of flaking devices attached to the leech of the sail at points spaced therealong, each of the flaking devices defining a passageway therethrough, the passageway having a principal axis disposed at an angle with respect to the substantially vertical plane of the sail when the latter is under tension in a raised position, each flaking device being a relatively inflexible, elongate tab having a substantially flat surface and being affixed at one of its ends to the leech, the passageway being defined proximate its other end, the plane of the substantially flat surface being generally coincident with that of the sail when raised, the principal axis of the passageway being oriented substantially at right angles thereto; and a douser line having a first end and a second end and an intermediate portion disposed therebetween, the first end thereof being affixed to the sail proximate the head of the sail, the intermediate portion of the douser line being run through successive passageways in the first and second flaking devices in alternately opposite directions, the douser line being substantially flaccid when the sail is in its raised position, the douser line being substantially straightened when tension applied to the sail to maintain it in its raised position is removed and a tensioned force is applied proximate the second end of the douser line to pull the sail downwardly, the straightened douser line forcing the principal axes of the passageways into alignment and rotating the first and second flaking devices in alternately opposite directions, the first and second flaking devices flaking the lowering sail proximate the leech thereof s the sail descends.

10. A system for dousing a sail, the sail having a head, a foot, a leech, a luff, a tack at one lower corner and a clew at the other lower corner, and for controlling the leech thereof, the system comprising:

a plurality of flaking devices attached to the leech of the sail at points spaced therealong, each of the flaking devices defining a passageway therethrough, the passageway having a principal axis disposed at an angle with respect to the substantially vertical plane of the sail when the latter is under tension in a raised position, each flaking device being formed by a portion of the leech defining an aperture therein that functions as a passageway, the principal axis of the passageway being oriented substantially at right angles to the planes of the sail when raised; and a continuous douser line having a first end and a second end and an intermediate portion disposed therebetween, the first end thereof being affixed to the sail proximate the head of the sail, the intermediate portion of the douser line being run through successive passageways in the flaking devices in alternately opposite directions, the douser line being substantially flaccid when the sail is in its raised position, the douser line being substantially straightened when tension applied to the sail to maintain it in its raised position is removed and a tensioning force is applied proximate the second end of the douser line to pull the sail downwardly, the straightened douser line forcing the principal axes of the passageways into alignment and rotating the flaking devices in alternately opposite directions, the flaking devices flaking the lowering sail proximate the leech thereof as the sail descends.

11. A system for dousing a sail, the sail having a head, a foot, a leech, a luff, a tack at one lower corner and a clew at the other lower corner, and for controlling the leech thereof, the system comprising:

a plurality of first flaking devices attached to the leech of the sail at points spaced therealong, each of the first flaking devices defining a passageway therethrough, the passageway having a principal axis disposed at a first angle with respect to the substantially vertical plane of the sail when the latter is under tension in a raised position;

a plurality of second flaking devices attached to the leech of the sail at points intermediate those at which the first flaking devices are attached, each of the second flaking devices defining a passageway therethrough, the passageway having a principal axis disposed at a second angle with respect to the substantially vertical plane of the sail, the first and second angles extending from opposite sides of the substantially vertical plane of the sail;

a douser line having a first end and a second end and an intermediate portion disposed therebetween, the first end thereof being affixed to the sail proximate the head of the sail, the intermediate portion of the douser line being run through successive passageways in the first and second flaking devices, the douser line being substantially flaccid when the sail is in its raised position, the douser line being substantially straightened when tension applied to the sail to maintain it in its raised position is removed and a tensioning force is applied proximate the second end of the douser line to pull the sail downwardly, the straightened douser line forcing the principal axes of the passageways into alignment and rotating the flaking devices in alternately opposite directions, the flaking devices flaking the lowering sail proximate the leech thereof as the sail descends.

12. A system for causing controlled flaking of a sail as it is lowered, the sail having a head, a foot, a leech, a luff, a tack at one lower corner and a clew at the other lower corner, and for controlling the leech thereof, the system comprising:

a sail track for arrangement in a generally vertical plane;

a series of pairs of looped-together sail slides and sail flaking devices to connect the sail luff at spaced-apart points therealong to the track for sliding movement along the track and rotation between positions either parallel or perpendicular to the track, the sail slide and sail flaking devices having rotation limiting portions at each of the spaced points arranged to prevent rotation in first one direction and then the other at the successive spaced points whereby, on lowering the sail, the luff is caused to flake first one way and then the other along the track;

a plurality of first flaking devices attached to the leech of the sail at points spaced therealong, each of the first flaking devices defining a passageway through that flaking device, the passageway being disposed at a first angle with respect to a first side of the plane of the sail when the latter is under tension in a raised position;

a plurality of second flaking devices attached to the leech of the sail at points intermediate those at which the first flaking devices are attached, each of the second flaking devices defining a passageway through that flaking device, the passageway being disposed at a second angle with respect to a second side of the plane of the sail;

a head block disposed proximate the head of the sail; and a douser line having one end thereof affixed proximate one lower corner of the sail, the douser line being run through the head block and returned proximate the foot of the sail, the douser line passing through the passageways in the first and second flaking devices such that, when tension applied to the sail is removed and tension is applied to the douser line, the passageways are forced into alignment, rotating the flaking devices in alternately opposite directions, the flaking devices flaking the now flaccid sail proximate the leech thereof as the sail descends.

13. A device for connecting a sail luff to a sail track and causing the sail to flake in a predetermined direction as it is lowered, the sail having a head, a foot, a leech, a luff, a tack at one lower corner and a clew at the other lower corner, the device comprising:

a sail slide and companion sail flaking device having generally U-shaped portions that are looped together, at least one of the U-shaped portions lying at an angle to the direction of the slide movement when the slide and flaking device are in operative positions during sail raising and lowering, the U-shaped portions being dimensionally sized in relation to the angle of the included plane to permit limited rotation between the slide and flaking device from a position in which a sail luff connected to the flaking device is parallel to sail slide movement to a position substantially perpendicular to the sail slide movement;

a plurality of first flaking devices attached to the leech of the sail at points spaced therealong, each of the first flaking devices defining a passageway therethrough, the passageway having a principal axis disposed at a first angle with respect to the substantially vertical plane of the sail when the latter is under tension in a raised position;

a plurality of second flaking devices attached to the leech of the sail at points intermediate those at which the first flaking devices are attached, each of the second flaking devices defining a passageway therethrough, the passageway having a principal axis disposed at a second angle with respect to the substantially vertical plane of the sail, the first and second angles extending from opposite sides of the substantially vertical plane of the sail; and a douser line having a first end and a second end and an intermediate portion disposed therebetween, the first end thereof being affixed to the sail proximate the head of the sail, the intermediate portion of the douser line being run through successive passageways in the first and second flaking devices, the douser line being substantially flaccid when the sail is in its raised position, the douser line being substantially straightened when tension applied to the sail to maintain it in its raised position is removed and a tensioning force is applied proximate the second end of the douser line to pull the sail downwardly, the straightened douser line forcing the principal axes of the passageways into alignment and rotating the flaking devices in alternately opposite directions, the flaking devices flaking the lowering sail proximate the leech thereof as the sail descends.

14. A self-flaking attachment for connecting a sail having a head, a foot, a leech, a luff a tack at one lower corner and a clew at the other lower corner to a track and permitting the luff and the leech to straighten when the sail is stretched along the track and for causing the luff and the leech to flake alternately when the sail collapses along the track, the self-flaking attachment comprising:

a series of pairs of interconnected sail slides and flaking devices spaced apart along the luff and track with the slide engaged with the track and the flaking device engaged with the luff;

each flaking device and slide of each pair having a generally U-shaped portion with such portions looped together to connect the slide and flaking device, the looped-together portions having contacting edge surfaces and being so angled with respect to each other that relative rotation between the flaking device and slide is limited to substantially 90 degrees between a position in which the sail luff adjacent each of the pairs is parallel to the track and a position in which the luff is perpendicular to the track, the contacting edge surfaces and the looped-together portions being so arranged that rotation is permitted alternately in opposite directions for successive pairs of flaking devices and slides;

a plurality of first flaking devices attached to the leech of the sail at points spaced therealong, each of the first flaking devices defining a passageway therethrough, the passageway having a principal axis disposed at a first angle with respect to the substantially vertical plane of the sail when the latter is under tension in a raised position;

a plurality of second flaking devices attached to the leech of the sail at points intermediate those at which the first flaking devices are attached, each of the second flaking devices defining a passageway therethrough, the passageway having a principal axis disposed at a second angle with respect to the substantially vertical plane of the sail, the first and second angles extending from opposite sides of the substantially vertical plane of the sail;

a head block disposed proximate the head of the sail; and a douser line having a first end and a second end and an intermediate portion disposed therebetween, the first end thereof being affixed proximate one lower corner of the sail, the intermediate portion of the douser line being run through the head block and returned proximate the foot of the sail, the intermediate portion of the douser line being run through successive passageways in the first and second flaking devices and through the head block, the douser line being substantially flaccid when the sail is in its raised position, the douser line being substantially straightened when tension applied to the sail to maintain it in its raised position is removed and a tensioning force is applied proximate the second end of the douser line to pull the sail downwardly, the straightened douser line forcing the principal axes of the passageways into alignment and rotating the flaking devices in alternately opposite directions, the flaking devices flaking the lowering sail proximate the leech thereof as the sail descends. alternately opposite directions, the flaking devices flaking the now flaccid sail proximate the leech.

15. A system for causing controlled flaking of a full-batten sail as it is lowered, the sail having a head, a foot, a leech, a luff, a tack at one lower corner and a clew at the other lower corner, the system comprising:

a sail track arranged in a generally vertical plane;

a sail having a luff and a leech with a series of battens extending substantially from the luff to the leech and spaced apart vertically therealong;

a series of pairs of looped-together sail slides and sail flaking devices to connect the luff end of each batten to the track for sliding movement along the track and rotation of the batten between positions either parallel or perpendicular to the direction of sliding movement along the track, the series of pairs of looped-together sail slides and flaking devices having rotation limiting portions at each batten arranged to prevent rotation in first one and then the other direction at successive battens whereby, on lowering the sail, the successive battens are flaked first in one direction and then the other as the sail collapses, a flaking device being connected to the luff end of each batten, the sail slide having an upstanding bail comprising a pair of legs connected by a bight portion and the sail flaking device being looped through the bail, the rotation-limiting portions comprising the legs of the bail and flaking device;

a plurality of first flaking devices attached to the leech of the sail at points spaced therealong, each of the first flaking devices defining a passageway through that flaking device, the passageway being disposed at a first angle with respect to a first side of the plane of the sail when the latter is under tension in a raised position;

a plurality of second flaking devices attached to the leech of the sail at points intermediate those at which the first flaking devices are attached, each of the second flaking devices defining a passageway through that flaking device, the passageway being disposed at a second angle with respect to a second side of the plane of the sail;

a head block disposed proximate the head of the sail; and a douser line having one end thereof affixed proximate one lower corner of the sail, the douser line being run through the head block and returned proximate the foot of the sail, the douser line passing through the passageways in the first and second flaking devices such that, when tension applied to the sail is removed and tension is applied to the douser line, the passageways are forced into alignment, rotating the flaking devices in alternately opposite directions, the flaking devices flaking the now flaccid sail proximate the leech thereof as the sail descends.

16. A self-flaking sail flaking device comprising:

a generally U-shaped member having a pair of laterally spaced-apart leg portions integrally connected at one end by a bight portion and having adjacent the opposite ends transversely aligned retainer-receiving apertures;

a retainer pin extending through and locked in the apertures;

a U-shaped, chafe-preventing member disposed within the flaking device and having a pair of legs connected together at one end by a bight portion and having at the opposite end a pair of aligned apertures with the pin extending through the apertures of the chafe-preventing member and with the bight portion of the chafe-preventing member spaced from the bight portion of the flaking device, the apertures of the flaking device lying in a plane intersecting the bight portion of the flaking device at an angle lying between and including approximately 30 and 80 degrees, the bight portion and legs of the flaking device having edges adapted to engage the bail of a sail slide through which the flaking device is looped to limit rotation of the flaking device on such bail between positions in which the pin is either perpendicular to the bail or parallel thereto;

a plurality of first flaking devices attached to the leech of the sail at points spaced therealong, each of the first flaking devices defining a passageway therethrough, the passageway having a principal axis disposed at a first angle with respect to the substantially vertical plane of the sail when the latter is under tension in a raised position;

a plurality of second flaking devices attached to the leech of the sail at points intermediate those at which the first flaking devices are attached, each of the second flaking devices defining a passageway therethrough, the passageway having a principal axis disposed at a second angle with respect to the substantially vertical plane of the sail, the first and second angles extending from opposite sides of the substantially vertical plane of the sail;

a head block disposed proximate the head of the sail; and a douser line having a first end and a second end and an intermediate portion disposed therebetween, the first end thereof being affixed proximate one lower corner of the sail, the intermediate portion of the douser line being run through the head block and returned proximate the foot of the sail, the intermediate portion of the douser line being run through successive passageways in the first and second flaking devices and through the head block, the douser line being substantially flaccid when the sail is in its raised position, the douser line being substantially straightened when tension applied to the sail to maintain it in its raised position is removed and a tensioning force is applied proximate the second end of the douser line to pull the sail downwardly, the straightened douser line forcing the principal axes of the passageways into alignment and rotating the flaking devices in alternately opposite directions, the flaking devices flaking the lowering sail proximate the leech thereof as the sail descends.

17. A self-flaking sail flaking device comprising:

a sail slide having a base member for sliding engagement with a sail track and a generally U-shaped bail fixed to and upstanding from the base member, the bail lying in a plane disposed perpendicular to the base member and inclined to the direction of slide movement during raising and lowering of a sail, the angle of inclination lying between approximately 30 and 80 degrees, the bail being adapted to cooperate with a sail flaking device looped therethrough and attached to the luff of the sail to limit rotation of the flaking device to approximately 90 degrees;

a plurality of first flaking devices attached to the leech of the sail at points spaced therealong, each of the first flaking devices defining a passageway therethrough, the passageway having a principal axis disposed at a first angle with respect to the substantially vertical plane of the sail when the latter is under tension in a raised position;

a plurality of second flaking devices attached to the leech of the sail at points intermediate those at which the first flaking devices are attached, each of the second flaking devices defining a passageway therethrough, the passageway having a principal axis disposed at a second angle with respect to the substantially vertical plane of the sail, the first and second angles extending from opposite sides of the substantially vertical plane of the sail;

a head block disposed proximate the head of the sail; and a douser line having a first end and a second end and an intermediate portion disposed therebetween, the first end thereof being affixed proximate one lower corner of the sail, the intermediate portion of the douser line being run through the head block and returned proximate the foot of the sail, the intermediate portion of the douser line being run through successive passageways in the first and second flaking devices and through the head block, the douser line being substantially flaccid when the sail is in its raised position, the douser line being substantially straightened when tension applied to the sail to maintain it in its raised position is removed and a tensioning force is applied proximate the second end of the douser line to pull the sail downwardly, the straightened douser line forcing the principal axes of the passageways into alignment and rotating the flaking devices in alternately opposite directions, the flaking devices flaking the lowering sail proximate the leech thereof as the sail descends.

* * * * *